United States Patent [19]

Ohkata

[11] Patent Number: 4,522,219

[45] Date of Patent: Jun. 11, 1985

[54] FREEZE PREVENTING VALVE

[75] Inventor: Ichizo Ohkata, Yokohama, Japan

[73] Assignee: Kato Hatsujo Kaisha Ltd., Yokohama, Japan

[21] Appl. No.: 603,768

[22] Filed: Apr. 25, 1984

[30] Foreign Application Priority Data

Dec. 31, 1983 [JP] Japan ..... 58-251434

[51] Int. Cl.[3] ..... E03B 7/12

[52] U.S. Cl. ..... 137/62; 60/527; 116/218; 137/468; 236/101 D; 237/80; 251/11

[58] Field of Search ..... 60/527; 116/216, 218; 137/59, 60, 61, 62, 79, 468; 236/66, 93 R, 101 D, 101 R; 237/80; 251/11; 374/197

[56] References Cited

U.S. PATENT DOCUMENTS

| | | | |
|---|---|---|---|
| 398,719 | 2/1889 | Gold | 137/468 |
| 1,392,617 | 10/1921 | Augustin | 137/59 |
| 3,403,238 | 9/1968 | Buehler et al. | 137/79 |
| 3,428,251 | 2/1969 | Gross et al. | 137/468 |
| 4,066,090 | 1/1978 | Nakajima et al. | 137/62 |
| 4,325,217 | 4/1982 | Golestaneh | 60/527 |
| 4,344,450 | 8/1982 | Walters | 137/62 |

*Primary Examiner*—George L. Walton

*Attorney, Agent, or Firm*—Schwartz, Jeffery, Schwaab, Mack, Blumenthal & Evans

[57] ABSTRACT

A freeze preventing valve which comprises a valve body longitudinally provided with an inserting hole at the upper part thereof in a hollow valve housing connected to a steam feed pipe, a valve element having a shaft disposed movably through the inserting hole of the valve body to be able to open an exhaust port at the lower end of the housing and to be vertically guided through the inserting hole of the housing. A collar is secured at an intermediate position on the shaft and a spring of shape memory alloy is interposed between the upper surface of a valve seat of the valve housing and the lower surface of the collar for urging the valve element to close the valve, by moving the valve element upwardly. A bias spring is mounted between the lower surface of the upper part of the valve body and the upper surface of the collar for urging the valve element to open the valve. Thus, the valve element of the freeze preventing valve is effectively operated by the both springs via the collar mounted on the shaft of the valve element, disposed in the valve body.

2 Claims, 3 Drawing Figures

FREEZE PREVENTING VALVE

BACKGROUND OF THE INVENTION

This invention relates to a freeze preventing valve which can prevent itself from freezing even if the valve is used in a cold district.

A room heater for a Diesel locomotive which travels in a cold district, for example, adopts in general a steam heater in view of structural and economical considerations. In this structure, valves for exhausting condensed water of steam are mounted at a predetermined interval at the suitable positions of a steam feed pipe. A valve of this type has heretofore been constructed, as shown in FIG. 1, to have a valve housing 2 connected to a steam feed pipe 1, an exhaust port 3 formed at the lower part of the housing 2, a valve element 4 disposed in the exhaust port 3 for opening or closing the exhaust port 3, a guide rod 5 for movably supporting the shaft 4*a* of the valve element 4, a valve body 6 for holding the rod 5 at the top thereof, and stainless bellows 7 disposed between the collar 5*a* of the rod 5 and the valve element 4. When the interior of the housing 2 is maintained by the stream at a high temperature, gas in the bellows 7 is heated and expanded to cause the bellows 7 to be elongated as shown in FIG. 1, thereby moving downwardly the valve element 4 to automatically close the exhaust port 3. Thus, when the steam is partly cooled to produce condensed water, which then flows into the housing 2 to thereby cool the bellows 7 through the pipe 1, the bellows 7 are contracted to move upwardly the valve element 4, with the result that the valve element 7 automatically opens the exhaust port 3. In this manner, the condensed water is naturally exhausted externally from the exhaust port 3 through a plurality of holes 6*a* perforated at the wall of the valve body 6.

Since the bellows 7 for automatically moving the valve element 4 upwardly or downwardly due to the temperature difference is, however, constructed to fill and seal the gas therein to be expanded as described above, the bellows 7 are affected by the influence of the fatigue of repeated elongations and contractions for a long period of time, and develop fine cracks, causing a gas leakage or improper opening or closing of the valve. Thus, the condensed water is concentrated in the valve housing in winter, the valve itself is thus frozen, and the valve housing is then damaged. Therefore, in order to protect against the freezing of condensed water in the valve a preliminary valve 8 is opened to discharge the condensed water, or the valve body is formed in a lateral type. However, this does not overcome the above-described drawbacks. To prevent the freeze of the valve of this type, it is necessary to check and maintain, and replace the bellows, and to provide a remedy of preventing the damage of the bellows themselves, i.e., the improvement of the durability in period and the reduction in the manufacturing cost.

SUMMARY OF THE INVENTION

Accordingly, an object of this invention is to provide a freeze preventing valve which can eliminate the aforementioned drawbacks and in which a spring of shape memory alloy is employed for moving a valve element upwardly or downwardly instead of bellows as a remedy of preventing the freeze of the valve.

According to the present invention, there is provided a freeze preventing valve in which a valve element is moved upwardly or downwardly by a structure in combination of a spring of shape memory alloy and a bias spring. More specifically, the valve element is elevationally moved upwardly or downwardly in combination of a spring of shape memory alloy and a bias spring, a valve body, at the upper part of which an inserting hole is perforated, is secured to a valve housing, a shaft of a valve element longitudinally provided in the inserting hole of the valve body is passed from the exhaust port of the valve body to support and guide the valve element. Further, a collar is formed substantially at an intermediate position of the valve element shaft slidably moved in the valve body. Then, a spring of shape memory alloy is mounted on the lower surface of the collar to close the valve element, while a bias spring is mounted on the upper surface of the collar to urge the valve element to open the valve element. The spring of shape memory alloy senses the temperature, thereby elongating or contracting itself. Thus, the exhaust port is automatically opened at a suitable time, thereby preventing the valve from being frozen. Thus, the above-described drawbacks are effectively eliminated.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

Figure 1:
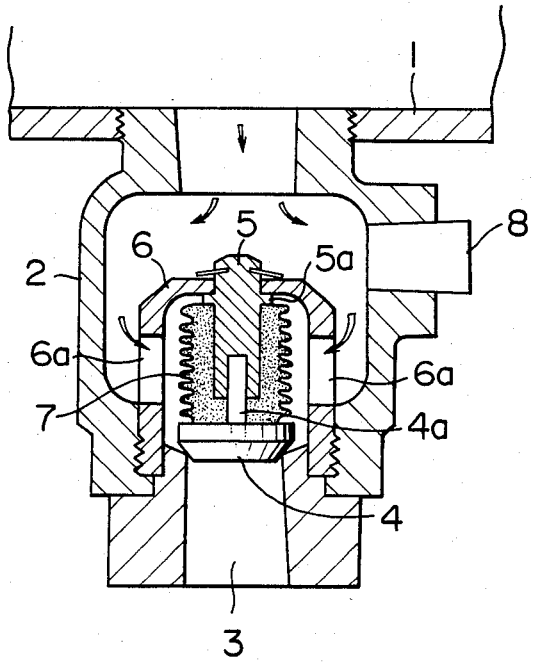
FIG. 1 is an elevational sectional view showing a conventional exhaust valve.
Figure 2A:
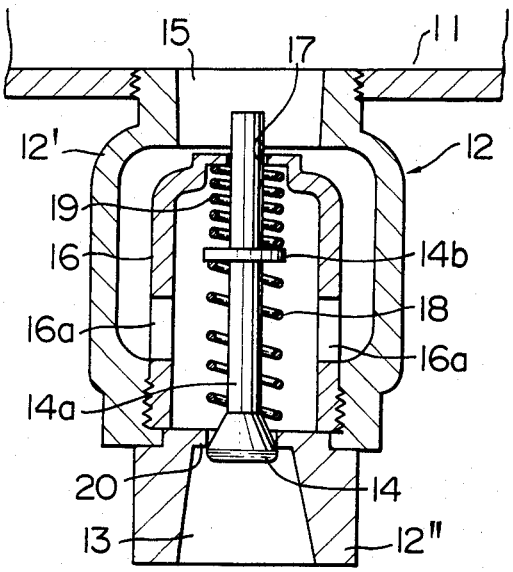
FIG. 2(A) is an elevational sectional view showing an embodiment of a freeze preventing valve in closed state according to the present invention.
Figure 2B:
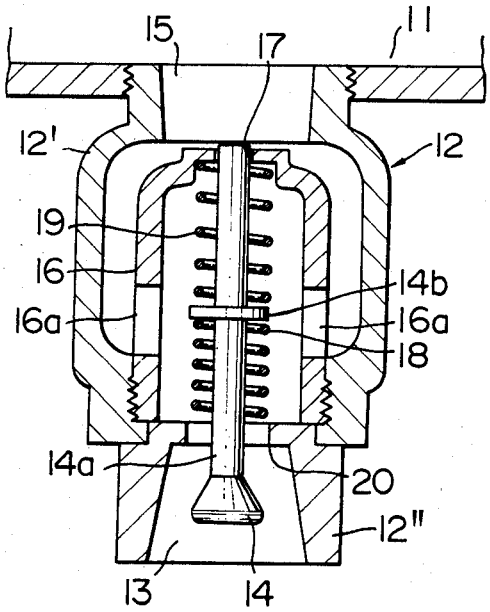
FIG. 2(B) is an elevational sectional view showing the valve of FIG. 1(A) in the open state.

An embodiment of a freeze preventing valve of the present invention will now be described in more detail with reference to the accompanying drawings. In FIGS. 2(A) and 2(B), a freeze preventing valve of the invention comprises a hollow valve housing 12 perforated with an inlet 15 connected by means such as threading in communication to a steam feed pipe 11, a valve body 16, at the upper part of which an inserting hole 17 is perforated, secured by means such as threading into the housing 12, and a valve element 14 having a longitudinally mounted shaft 14*a* inserted into the inserting hole 17 opened at the upper end of the valve body 16 from the exhaust port 13 opened at the lower end of the housing 12 and for supporting and guiding the valve element 14 in the inserting hole 17.

Further, a collar 14*b* is provided substantially at the intermediate position of the shaft 14*a* of the valve element 14, a coiled spring 18 of nickel-titanium shape memory alloy is mounted between the lower surface of the collar 14*b* and the upper surface of the exhaust port 13 to always urge the valve element 14 in an upward direction to close the valve element 14 and a bias spring 19 is mounted between the upper surface of the collar 14*b* and the lower surface of the upper part of the valve body 16 to always urge the valve element 14 in a downward direction to open the valve element 14. In the embodiment shown in FIGS. 2(A) and 2(B) the valve housing 12 is composed of a main cylindrical body 12' connected to the steam feed pipe 11 and a sub-cylindrical body 12" engaged underneath the main cylindrical body 12' and formed with an exhaust port 13. Reference numeral 20 designates a valve seat formed on the upper end of the sub-cylindrical body 12" of the valve housing 12 so that the valve element can be seated thereon at the lower end.

The tensions of the springs 18 and 19 are so selected that, when the interior of the valve housing 12 is maintained at a predetermined high temperature during the passing of steam, the tension of the spring 18 overcomes the tension of the bias spring 19. When the interior of the housing 12 is lowered to a predetermined low temperature due to the concentration of condensed water of the steam, the spring 18 is contracted so as to allow, reversely, the tension of the spring 19 to overcome that of the spring 18.

The shape memory effect of the nickel-titanium shape memory alloy is produced by martensite transformation, and depends upon the temperature for recovering the operating temperature and hence the shape of the alloy. More specifically the martensite transformation of the nickel-titanium alloy largely changes according to a small amount of the alloy composition and also varies according to the temperature for treating the shape memory.

Therefore, the hysteresis of the transformation temperatures at cooling and heating times is peculiar for each alloy. Thus, since the characteristic of the shape memory alloy cannot be varied, the hysteresis is reduced by utilizing the tension of the bias spring 19. More particularly, both the spring 18 of shape memory alloy and the bias spring 19 are simultaneously employed to construct a reversibly repeating mechanism in bidirectional operations.

In the freeze preventing valve of the invention thus constructed, the steam in the steam feed pipe 11 is partly cooled and condensed to produce condensed water, and when the condensed water flows into the hollow valve housing 12 through the inlet 15 to lower the temperature in the housing 12, the spring 18 of nickel-titanium shape memory alloy contracts so that the tension of the bias spring 19 overcomes that of the spring 18. Thus, as shown in FIG. 2B, the spring 18 of shape memory alloy contracts, the valve element 14 moves downwardly in the inserting hole 17 of the valve body 16 by the supporting and guiding actions of the inserting hole 17 to automatically open the exhaust port 13, thereby naturally exhausting externally the condensed water through the holes 16*a* perforated at the wall of the valve body 16 from the exhaust port 13. When the interior of the valve housing 12 is again heated to a predetermined high temperature with the steam after the condensed water is completely exhausted in this manner, the spring 18 of shape memory alloy is elongated to overcome the tension of the bias spring 19. Thus, the valve element 14 is again moved upwardly, as shown in FIG. 2(A), in the inserting hole 17 by the supporting and guiding actions of the hole 17, thereby automatically closing the exhaust port 13.

According to the present invention as described above, since the freeze preventing valve comprises a valve body 16 longitudinally provided with an inserting hole 17 at the upper part thereof in a hollow valve housing 12 connected to a steam feed pipe 11, a valve element 14 having a shaft 14*a* is disposed for movement through the inserting hole 17 of the valve 16, to open an exhaust port 13 at the lower end of the housing 12, and to be elevationally guided through the inserting hole 17 of the housing 12. A collar 14*b* is secured at the intermediate position of the shaft 14*a* and a spring 18 of shape memory alloy is interposed between the upper surface of a valve seat 20 of the valve housing 12 and the collar 14*b* for urging the valve element to a closed position. A bias spring 19 is mounted between the lower surface of the upper part of the valve body 16 and the collar 14*b* for urging the valve element 14 to an open position. The valve body 16 is formed with a plurality of holes 16*a* to be closed from the exhaust port 13 by the valve element 14 when steam is introduced from the pipe 11, through the housing 12, into the valve body 16, to heat and elongate the spring 18 of shape memory alloy. Holes 16*a* are opened to the exhaust port 13 by upward movement of the valve element 14 when condensed water from the pipe 11 is introduced through the housing 12 into the valve body 16. This will contract spring 18 of shape memory alloy due to the tension of the bias spring 19, the valve element 14 of the freeze preventing valve is effectively operated by the both springs 18 and 19 via the collar 14*b* mounted at the shaft 14*b* of the valve element disposed in the valve body 16. Thus, the exhaust port 13 can be automatically opened and closed with the spring 18 of shape memory alloy and the bias spring 19 instead of the conventional bellows. This particularly improves the operation of the freeze preventing valve in winter, thereby completely eliminating the trouble that a gas leakage from the conventional bellows causes. Moreover, the necessity of providing a preliminary valve as in the conventional valve to prevent the valve from being frozen can be obviated. Consequently, inspections for frozen valves and the replacement of cracked bellows are eliminated due to the use of the springs of shape memory alloy and bias, thereby providing the possibility of semi-permanently using the freeze preventing valve and a reduction in the cost of the valve.

Since in the present invention the valve element 14 is not disposed in the valve body 16 but disposed at the lower part of the valve seat 20, i.e., in the exhaust port 13, the condensed water can smoothly flow out at the time of exhausting the water.

What is claimed is:

1. A freeze preventing valve comprising:

a valve body longitudinally provided with an inserting hole at the upper part thereof in a hollow valve housing connected to a steam feed pipe, a valve element having a shaft disposed movably through the inserting hole of said valve body to be able to open an exhaust port opened at the lower end of the housing, to be vertically guided through the inserting hole of the housing and having a collar secured at an intermediate position on said shaft, a spring of shape memory alloy interposed between the upper surface of a valve seat of the valve housing and the lower surface of the collar for urging the valve element to close said valve by moving the valve element upwardly, a bias spring mounted between the lower surface of the upper part of the valve body and the upper surface of the collar for urging said valve element to open said valve, said valve body being formed with a plurality of holes to be closed to the exhaust port by said valve element when steam is introduced from said pipe, through the housing, into said valve body, to heat and expand said spring of shape memory alloy and to be opened to the exhaust port by upward movement of said valve element when condensed water from the pipe is introduced, through the housing, into said valve body to contract said spring of shape memory alloy by the tension of said bias spring.

2. The freeze preventing valve according to claim 1, wherein said hollow valve housing comprises a main cylindrical body connected to the steam feed pipe, and a sub cylindrical body engaged with said main cylindrical valve and formed with an exhaust port, and a valve seat is provided on the upper part of said sub cylindrical body so that said valve element will be closed upon upward movement of said valve element.

* * * * *